US005089226A

United States Patent [19]

Ohashi et al.

[11] Patent Number: 5,089,226

[45] Date of Patent: Feb. 18, 1992

[54] METHOD FOR PROTECTING AUSTENITIC STAINLESS STEEL-MADE EQUIPMENT FROM OCCURRENCE OF STRESS-CORROSION CRACKING

[75] Inventors: Mitsuhiro Ohashi; Shuzo Mimaya, both of Okayama, Japan

[73] Assignee: Nippon Mining Co., Ltd., Tokyo, Japan

[21] Appl. No.: 316,579

[22] Filed: Feb. 28, 1989

Related U.S. Application Data

[63] Continuation of Ser. No. 4,946, Jan. 20, 1987, abandoned.

[30] Foreign Application Priority Data

Jan. 20, 1986 [JP] Japan ..... 61-8013

[51] Int. Cl.[5] ..... C23F 11/14

[52] U.S. Cl. ..... 422/16; 252/392; 252/394; 252/396; 422/7

[58] Field of Search ..... 422/7, 16; 252/392, 252/394, 396

[56] References Cited

U.S. PATENT DOCUMENTS

| | | | |
|---|---|---|---|
| 2,196,261 | 4/1940 | Howland et al. | 422/7 |
| 2,472,400 | 6/1949 | Bond et al. | 422/7 |
| 2,496,596 | 2/1950 | Moyer et al. | 422/7 |
| 2,614,980 | 10/1952 | Lytle | 422/7 |
| 3,034,907 | 5/1962 | Kleemann et al. | 422/7 |
| 3,123,634 | 3/1964 | Udelhofen | 422/7 |
| 3,447,891 | 6/1969 | Crawford | 422/9 |
| 3,687,611 | 8/1972 | Liddell | 422/7 |
| 4,024,048 | 5/1977 | Shell et al. | 252/400.2 |
| 4,062,764 | 12/1977 | White et al. | 422/7 |
| 4,460,482 | 7/1984 | Wu | 422/7 |
| 4,511,001 | 4/1985 | Wu | 422/7 |
| 4,532,109 | 7/1985 | Maeda et al. | 422/240 |

FOREIGN PATENT DOCUMENTS

| | | |
|---|---|---|
| 283079 | 7/1970 | Austria . |
| 288109 | 2/1971 | Austria . |
| 301984 | 8/1972 | Austria . |
| 327636 | 2/1976 | Austria . |
| 2340112 | 2/1974 | Fed. Rep. of Germany . |

*Primary Examiner*—Robert J. Warden
*Assistant Examiner*—Timothy M. McMahon
*Attorney, Agent, or Firm*—Sughrue, Mion, Zinn, Macpeak & Seas

[57] ABSTRACT

A method of protecting an austenitic stainless steel-made equipment to be exposed to a fluid containing sulfides from the occurrence of stress-corrosion cracking is disclosed, comprising washing the equipment with a mineral oil containing at least one compound selected from organic amines and acid amide compounds in stopping the operation thereof.

2 Claims, No Drawings

METHOD FOR PROTECTING AUSTENITIC STAINLESS STEEL-MADE EQUIPMENT FROM OCCURRENCE OF STRESS-CORROSION CRACKING

This is a continuation of application Ser. No. 07/004,946, filed Jan. 20, 1987 now abandoned.

FIELD OF THE INVENTION

The present invention relates to a method for protecting an austenitic stainless steel-made equipment which is to be exposed to fluids containing sulfides in oil refinery or petrochemical industry, such as, a furnace, a reaction column, or a heat exchanger of a hydrodesulfurization apparatus, from the occurrence of stress-corrosion cracking.

BACKGROUND OF THE INVENTION

A furnace, a reaction column, a heat exchanger, and so on of, for example, a hydrodesulfurization apparatus are exposed to fluids containing high-temperature sulfides during the operation, whereby iron sulfide is formed on the surface thereof. This iron sulfide, when exposed to the air, is hydrolyzed by the action of oxygen and moisture and is converted into polythionic acid, causing the occurrence of stress-corrosion cracking of an austenitic stainless steel used in the equipment.

In order to eliminate this problem, a method in which in stopping the operation, the fluids are withdrawn from the equipment and the inside of the equipment is washed and neutralized with an aqueous solution of an inorganic alkali such as sodium carbonate, caustic soda, or ammonia has heretofore been employed (see NACE Standard, RP01-70, titled "Protection of Austenitic Stainless Steel in Refineries Against Stress Corrosion Cracking by Use of Neutralizing Solutions During Shut Down").

In accordance with the above method comprising washing and neutralizing with an aqueous alkali solution, however, because the surface of the equipment is wet with fluids containing sulfides and repels the aqueous alkali solution, contact of the aqueous alkali solution with iron sulfide formed on the surface of the equipment is achieved insufficiently such that protection from the occurrence of stress-corrosion cracking cannot be ensured. Furthermore, the aqueous alkali solution for washing and neutralization sometimes remains in dead portions of the equipment and pipes to cause corrosion. Moreover, the above method involves such a problem that it is necessary to once withdraw the fluid remaining in the equipment and then introduce the aqueous alkali solution, which makes the operation complicated.

SUMMARY OF THE INVENTION

The present invention is intended to overcome the above-described problems. An object of the present invention is, therefore, to provide a method enabling to prevent an aqueous alkali solution from remaining in dead portions of an equipment or pipes to cause corrosion, ensure washing and neutralization or formation of an anti-corrosive coating, and to make the operation simplified, whereby an austenitic stainless steel can be protected from the occurrence of stress-corrosion cracking.

It has been found that the above object can be attained by washing with a mineral oil containing at least one compound selected from organic amines and acid amide compounds.

The present invention relates to a method for protecting an austenitic stainless steel-made equipment which is to be exposed to fluids containing sulfides, from the occurrence of stress-corrosion cracking, which process comprises washing the equipment with a mineral oil containing at least one compound selected from organic amines and acid amide compounds in stopping the operation.

DETAILED DESCRIPTION OF THE INVENTION

Examples of fluids containing sulfides which are referred to herein are light hydrocarbons, such as methane, ethane, propane, and butane, and atmospheric or vacuum distillation fractions or residual oils, such as naphtha, kerosene, light oil, heavy oil, and asphalt, as well as coal liquefied oil, tar sand oil, and mineral oils or gases of their cracked products.

The term "austenitic stainless steel-made equipment" as referred to herein means an equipment made of, e.g., an austenitic stainless steel, called 18-8, 18-SLC, 25-20, 16-12-Mo, 18-10-Ti, or 18-10-Cb. In general, furnaces, reactors, and heat exchangers of hydrodesulfurization or hydrocracking apparatus are made of such an austenitic stainless steel.

When the austenitic stainless steel is exposed for a certain period of time within the temperature range employed for hydrodesulfurization or hydrocracking apparatus, chromium carbide in the stainless steel becomes precipitated in the crystal grain boundary to decrease the concentration of chromium in the neighborhood of the grain boundary and form a chromium lack layer, whereby it is acuminated. It is considered that if the stainless steel is exposed to polythionic acid in this state, stress-corrosion cracking occurs.

Therefore, if the formation of polythionic acid is prevented, that is, iron sulfide on the surface of the stainless steel is prevented from the contact with oxygen or moisture to be converted into polythionic acid, the occurrence of stress-corrosion cracking can be prevented. For achieving this object, when the operation of the equipment is stopped, the equipment is washed with an organic amine- or acid amide compound-containing mineral oil without withdrawing the fluid remaining in the equipment or without opening the equipment even after the fluid remaining in the equipment has been withdrawn, in other words, without bring the fluid into contact with oxygen or moisture.

As the organic amine compound, any of primary, secondary and tertiary, or aliphatic, alicyclic and aromatic amine compounds can be used without a hitch. Particularly preferred are amine compounds which are of low volatility and are relatively inexpensive, such as cyclohexylamine, methylamine, diethylamine, monoethanolamine, isopropanolamine, and morpholine.

As the acid amide compound, any of primary, secondary and tertiary acid amide compounds can be used. In addition, the acid moiety of the acid amide compound can be any of fatty, alicyclic and aromatic acids, and N-substituted products of acid amides in the form of a compound between acid and amine can be used without a particular hitch. Particularly preferred are acid amides of a higher fatty acid having from 10 to 22 carbon atoms and acid amide compounds of this higher fatty acid and cyclohexylamine.

The organic amine or acid amide compound (hereinafter sometimes simply referred to as "the compound") is used as a neutralizing agent or film forming agent which is one kind of anti-corrosive agents. In the present invention, commercially available neutralizing agents or film forming agents containing the above-described organic amine or acid amide compound can be used.

As a matter of course, the organic amine or acid amide compound can be used alone or in combination with two or more thereof. The compound is used upon being dissolved in or mixed with a mineral oil. In this case, it is preferred that the concentration of the compound in the mineral oil is 0.005% by weight or more. If the concentration of the compound is less than 0.005% by weight, the effect of preventing the occurrence of stress-corrosion cracking cannot substantially be expected. As the concentration of the compound is increased, the above effect is increased. However, at concentrations exceeding 5% by weight, no further marked increase in the effect is observed and, hence, the use of such high concentrations of the compound is not preferred from the economic standpoint.

As the mineral oil to which the above compound is to be added, it is preferred that the fluid supplied to the equipment is used as it stands and the above-described compound is added thereto because the washing operation is simple. In the case that the fluid is a heavy oil such as a residual oil, if a light oil fraction such as kerosene or a light oil is used, washing of the heavy oil attached to the inner wall of the equipment can also be achieved and, hence, such employment is preferable.

The washing operation can be carried out over an entire system of the apparatus including the equipment to be processed in a simplified manner by flowing the mineral oil containing the above-described compound in the flow direction of the fluid fed to the equipment. In order to increase the effect of washing, it is preferred that the washing is carried out repeatedly by circulating the mineral oil containing the above-described compound.

It is also possible that the equipment to be processed is eliminated from the system and washed by introducing the above-described mineral oil therein. In this case, the washing is sufficiently carried out by merely contacting the mineral oil with the inner wall of the equipment to be processed without particular need of agitation or other means.

The waste liquor after washing is recovered as a slop as it stands and can be purified to a product. On the other hand, in accordance with the conventional method using an aqueous alkali solution, unless the remaining materials in the equipment are completely removed, the waste liquor is seriously contaminated so that much labors are needed in processing the waste liquor whereby the washing operation become complicated.

In accordance with the present invention, when iron sulfide formed on a surface of an austenitic stainless steel is contacted with a mineral oil containing an organic amine or an acid amide compound, the iron sulfide is washed and neutralized with the organic amine or acid amide compound and, even when exposed to air, it does not produce polythionic acid by the action of oxygen and water, whereby the occurrence of stress-corrosion cracking in the austenitic stainless steel can be prevented.

The present invention is described in greater detail with reference to the following Example.

EXAMPLE

An iron sulfide scale was collected from a heat exchanger installed at the outlet of a reactor of a heavy oil indirect desulfurization apparatus so as to not bring it into contact with air and, then, washed with tetrahydrofuran, followed by drying. 15 g of the scale was wrapped by a 60-mesh wire screen and soaked for 5 minutes in a solution of each of compounds shown in Table 1 dissolved in a heavy light oil fraction in the concentration shown in Table 1. Then, the iron sulfide scale was heated to 150° C in a stream of nitrogen and cooled to room temperature. Thereafter, the scale was placed in a 100-ml beaker containing 10 ml of pure water.

A 15 mm×100 mm 18-8 stainless steel (Type 304) having a thickness of 2 mm was previously heated for 24 hours at a temperature of 650° C., subjected to wet abrasion using an FEPA-P #150 (95μ) abrasion paper, and deformed by bending so as to wind on a copper pipe having a diameter of 13.8 mm. Then, it was clamped with a bolt and a nut until the straight plate portions had become in parallel (the distance between the straight plate portions was 14 mm). This assembly was used as a sample.

This sample was soaked in the above beaker and taken out at certain period intervals, and the occurrence of stress-corrosion cracking was examined by the use of a microscope. At this time, the pH of the solution was measured.

The results are shown in Table 2.

TABLE 1

| Run No. | Compound | Amount (wt %) |
|---|---|---|
| 1 | Cyclohexylamine | 2 |
| 2 | Cyclohexylamine | 0.2 |
| 3 | Cyclohexylamine | 0.02 |
| 4 | Cyclohexylamine | 0.002 |
| 5 | Cyclohexylamine | 0.001 |
| 6 | Diethylamine | 0.2 |
| 7 | Diethylamine | 0.02 |
| 8 | Diethylamine | 0.002 |
| 9 | Cy—NH—CO—R* | 2 |
| 10 | Cy—NH—CO—R* | 0.2 |
| 11 | Cy—NH—CO—R* | 0.02 |
| 12 | Cy—NH—CO—R* | 0.002 |
| 13 | Mixture of Cy—NH—CO—R and cyclohexylamine | each 0.2 |
| 14 | Not added | — |

*Cy = cyclohexyl group
R = mixture of alkyl groups having from 10 to 18 carbon atoms

TABLE 2

| Run No. | Time until formation of cracking (hours) | pH* |
|---|---|---|
| 1 | 120 | 5.5 |
| 2 | 56 | 5.5 |
| 3 | 56 | 5.0 |
| 4 | 35 | 4.5 |
| 5 | 28 | 3.5 |
| 6 | 56 | 5.6 |
| 7 | 56 | 4.4 |
| 8 | 35 | 4.0 |
| 9 | 72 | 1.5 |
| 10 | 42 | 1.5 |
| 11 | 42 | 1.5 |
| 12 | 28 | 1.5 |
| 13 | 98 | 5.5 |

TABLE 2-continued

| Run No. | Time until formation of cracking (hours) | pH* |
|---|---|---|
| 14 | 21 | 1.5 |

*The pH is a pH at which the cracking occurred.

It can be seen from the foregoing results that when iron sulfide is contacted with a mineral oil containing an organic amine or an acid amide compound, the formation of polythionic acid is prevented and, thus, the occurrence of stress-corrosion cracking of an austenitic stainless steel can be prevented.

In the present invention, in stopping the operation of an austenitic stainless steel-made equipment exposed to a fluid containing sulfides, the equipment is washed with a mineral oil containing at least one compound selected from organic amines and acid amide compounds, whereby the washing is ensured and the occurrence of stress-corrosion cracking of the austenitic stainless steel can be prevented. Furthermore, the problem of the occurrence of corrosion encountered in using an aqueous alkali solution as a result of its residence in dead portions of the equipment or pipes can be eliminated, and no special attention to pay for the disposal of a waste liquor is necessary. Thus, there can be obtained an additional advantage that the washing operation can be carried out with ease.

While the invention has been described in detail and with reference to specific embodiments thereof, it will be apparent to one skilled in the art that various changes and modifications can be made therein without departing from the spirit and scope thereof.

What is claimed is:

1. A method of protecting austenitic stainless steel-made equipment exposed to fluid containing sulfides and to temperatures for hydrodesulfurization or hydrocracking from the occurrence of stress-corrosion cracking caused by being exposed to polythionic acid formed from sulfide scales, water and oxygen, which comprises washing the equipment with a mineral oil containing at least one compound selected from acid amide compounds, or containing at least one compound selected from acid amide compounds and at least one compound selected from organic amines, wherein the acid amide compound is one selected from acid amide compounds which are reaction products of a higher fatty acid having from 10 to 22 carbon atoms and cyclohexylamine, to prevent the formation of polythionic acid, before the sulfide scales are contacted with oxygen and moisture, said washing to occur while the operation of the equipment is temporarily stopped.

2. A method of protecting austenitic stainless steel-made equipment exposed to fluid containing sulfides and to temperatures for hydrodesulfurization or hydrocracking from the occurrence of stress-corrosion cracking caused by being exposed to polythionic acid formed from sulfide scales, water and oxygen, which comprises washing the equipment with a mineral oil containing at least one compound selected from acid amide compounds, or containing at least one compound selected from acid amide compounds and at least one compound selected from organic amines, wherein the mineral oil contains a reaction product of a higher fatty acid having from 10 to 22 carbon atoms and cyclohexylamine, and cyclohexylamine, to prevent the formation of polythionic acid, before the sulfide scales are contacted with oxygen and moisture, said washing to occur while the operation of the equipment is temporarily stopped.

* * * * *